US010405670B1

(12) United States Patent
Mullenaux

(10) Patent No.: US 10,405,670 B1
(45) Date of Patent: Sep. 10, 2019

(54) WATER DISPENSING SYSTEM FOR FURNITURE

(71) Applicant: Thomas Mullenaux, San Pedro, CA (US)

(72) Inventor: Thomas Mullenaux, San Pedro, CA (US)

( * ) Notice: Subject to any disclaimer, the term of this patent is extended or adjusted under 35 U.S.C. 154(b) by 0 days.

(21) Appl. No.: 16/140,603

(22) Filed: Sep. 25, 2018

(51) Int. Cl.

| | |
|---|---|
| ***A47C 19/22*** | (2006.01) |
| ***A47C 7/62*** | (2006.01) |
| ***B67D 1/00*** | (2006.01) |
| ***B67D 1/08*** | (2006.01) |

(52) U.S. Cl.
CPC ..... *A47C 19/22* (2013.01); *A47C 7/622* (2018.08); *B67D 1/0004* (2013.01); *B67D 1/0014* (2013.01); *B67D 1/0889* (2013.01); *B67D 2001/0097* (2013.01); *B67D 2210/0001* (2013.01); *B67D 2210/00031* (2013.01); *B67D 2210/00049* (2013.01); *B67D 2210/00149* (2013.01)

(58) Field of Classification Search
CPC ..... A47C 19/22; A47C 7/622; B67D 1/0004; B67D 1/0014; B67D 1/0889; B67D 2001/0097; B67D 2210/0001; B67D 2210/00031; B67D 2210/00049; B67D 2210/00149
USPC ..... 222/192; 137/374
See application file for complete search history.

(56) References Cited

U.S. PATENT DOCUMENTS

| | | | | |
|---|---|---|---|---|
| 3,120,404 | A * | 2/1964 | Bramming | A45C 9/00 190/8 |
| 3,560,047 | A * | 2/1971 | Davis | A47C 1/16 297/188.01 |
| 3,745,596 | A | 7/1973 | Copeland | |
| 4,420,097 | A * | 12/1983 | Motsenbocker | A45F 3/16 222/131 |
| 4,533,050 | A * | 8/1985 | Bake, Jr. | A45C 9/00 206/217 |
| D293,393 | S * | 12/1987 | Bothun | D6/335 |
| 4,871,069 | A * | 10/1989 | Guimont | A45C 9/00 206/545 |
| 5,090,075 | A | 2/1992 | Larson | |
| D342,393 | S | 12/1993 | Discepolo | |
| 5,271,837 | A | 12/1993 | Discepolo | |
| 5,722,596 | A * | 3/1998 | Dome | A47C 1/14 239/289 |
| 6,513,343 | B2 | 2/2003 | Pahl | |
| 6,966,464 | B2 * | 11/2005 | Betkowski | A47C 1/16 222/192 |

(Continued)

*Primary Examiner* — Patrick M. Buechner
*Assistant Examiner* — Michael J. Melaragno
(74) *Attorney, Agent, or Firm* — Kyle A. Fletcher, Esq.

(57) ABSTRACT

The water dispensing system for furniture includes a water dispensing system that is built into or attached onto an item of furniture. Water is stored within a reservoir within a water system housing and may be pumped through a filter to one of two retractable hoses. Optionally, the water is provided via a water line that connects to plumbing of a respective building in which the item of furniture is located. At least one retractable hose is provided, and includes a mouthpiece. When the at least one retractable hose is released, said hose is pulled back into the item of furniture to stay out of the way. When not in use, the retractable hoses are wound around spring-loaded reels.

18 Claims, 7 Drawing Sheets

(56) References Cited

U.S. PATENT DOCUMENTS

| | | | | |
|---|---|---|---|---|
| 8,123,290 | B1 * | 2/2012 | Aiken | A47C 31/11 297/180.1 |
| 8,297,695 | B1 * | 10/2012 | Aiken | A47C 31/11 297/180.1 |
| 10,161,564 | B1 * | 12/2018 | Delobel | A47C 7/622 |
| 10,219,631 | B1 * | 3/2019 | Jimenez | A47C 7/70 |
| 2004/0049845 | A1 * | 3/2004 | Gallant | A61G 7/00 4/664 |
| 2016/0231029 | A1 | 8/2016 | Pan | |
| 2018/0263394 | A1 * | 9/2018 | Thomas | A47G 23/0225 |
| 2018/0332972 | A1 * | 11/2018 | Jaeckel | A47C 7/622 |
| 2018/0368599 | A1 * | 12/2018 | Delobel | A47G 23/02 |

* cited by examiner

WATER DISPENSING SYSTEM FOR FURNITURE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of a water-dispensing system that can be installed on or in an item of furniture, more specifically, a water dispensing system for furniture that enables an end user to stay hydrated whilst on said item of furniture.

SUMMARY OF INVENTION

The water dispensing system for furniture includes a water dispensing system that is built into or attached onto an item of furniture. Water is stored within a reservoir within a water system housing and may be pumped through a filter to one of two retractable hoses. Optionally, the water is provided via a water line that connects to plumbing of a respective building in which the item of furniture is located. At least one retractable hose is provided, and includes a mouthpiece. When the at least one retractable hose is released, said hose is pulled back into the item of furniture to stay out of the way. When not in use, the retractable hoses are wound around spring-loaded reels.

An object of the invention is to provide a water dispensing system that dispenses water through a mouthpiece coupled to a retractable hose, which in turn is provided on or in the item of furniture.

Another object of the invention is to provide a reservoir to hole the water to be dispensed.

A further object of the invention is to provide a pump to move the water through the water dispensing system.

Yet another object of the invention is to provide a filter to purify the water passing through the water dispensing system.

Yet another object of the invention is to provide a water line that is used in lieu of the water reservoir, and which is connected to the plumbing provided in the building where the item of furniture is located.

These together with additional objects, features and advantages of the water dispensing system for furniture will be readily apparent to those of ordinary skill in the art upon reading the following detailed description of the presently preferred, but nonetheless illustrative, embodiments when taken in conjunction with the accompanying drawings.

In this respect, before explaining the current embodiments of the water dispensing system for furniture in detail, it is to be understood that the water dispensing system for furniture is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water dispensing system for furniture.

It is therefore important that the claims be regarded as including such equivalent construction insofar as they do not depart from the spirit and scope of the water dispensing system for furniture. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
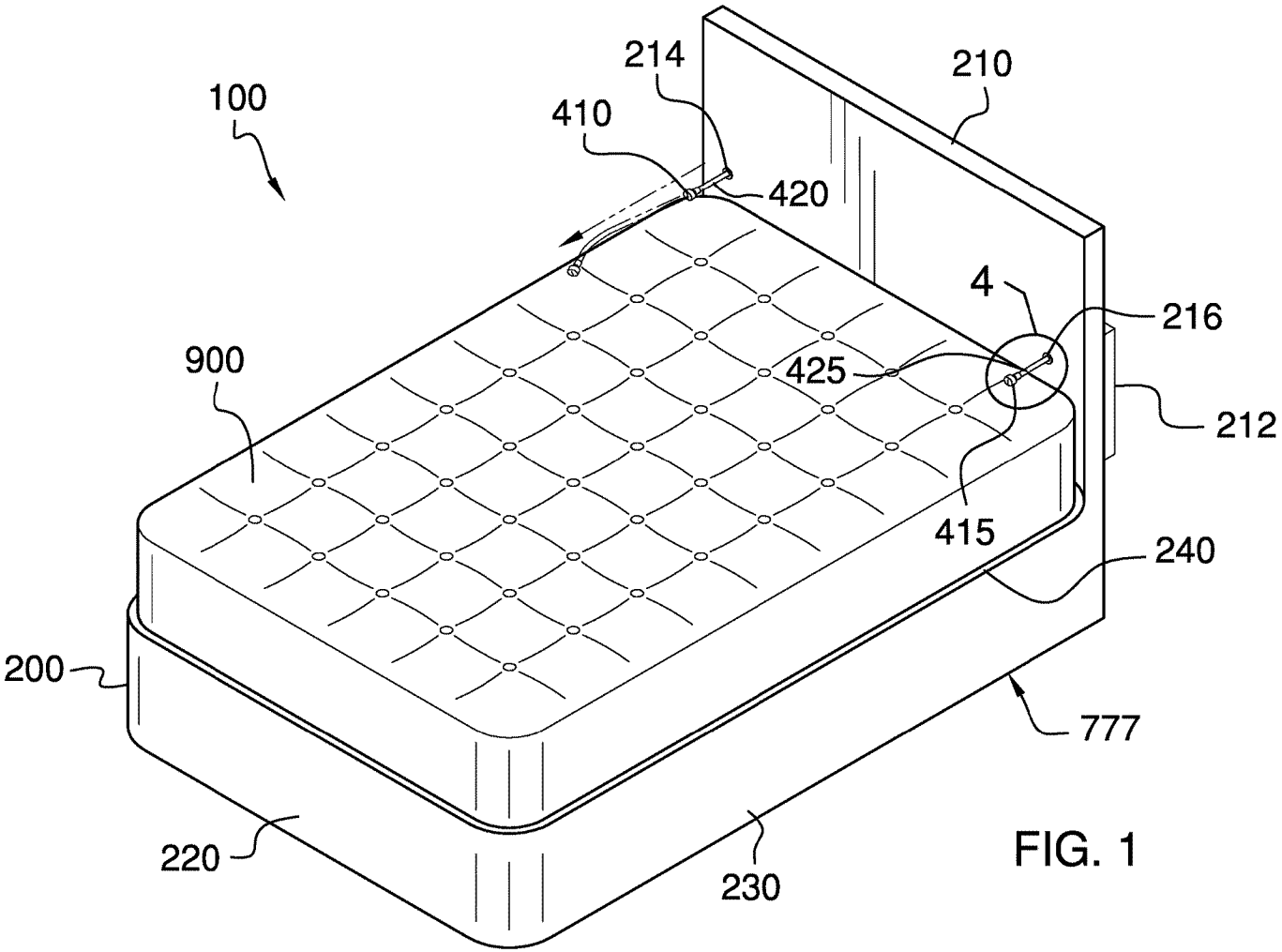
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 6.

The water dispensing system for furniture 100 (hereinafter invention) comprises a water dispensing system 400 and an item of furniture 777. As a preliminary matter, the invention 100 may be designed for use with a plurality of different types of furniture (see FIG. 6 as one example). That being said, the item of furniture 777 may be a bed, a futon, a Murphy bed, a pull out sofa-bed, a sofa, a couch, a recliner, a settee, a chair, or other item of furniture that is typically associated with the above listed items.

For purposes of illustration herein, the item of furniture 777 is a bed, which is further defined with a bed frame 200, and a headboard 210. The invention 100 is adapted to dispense water 910 to occupants of said item of furniture 777 from a water reservoir 430 located in the headboard 210.

The water dispensing system 400 comprises the water reservoir 430, a filter 440, a pump 450, a valve 460, a first retractable hose 420, a second retractable hose 425, a first mouthpiece 410, and a second mouthpiece 415. The water 910 stored in the water reservoir 430 may flow through the filter 440 to remove impurities and may be pumped to the valve 460. The valve 460 may start and stop the flow of the water 910 to the first mouthpiece 410 via the first retractable hose 420 or to the second mouthpiece 415 via the second retractable hose 425.

Figure 2A:
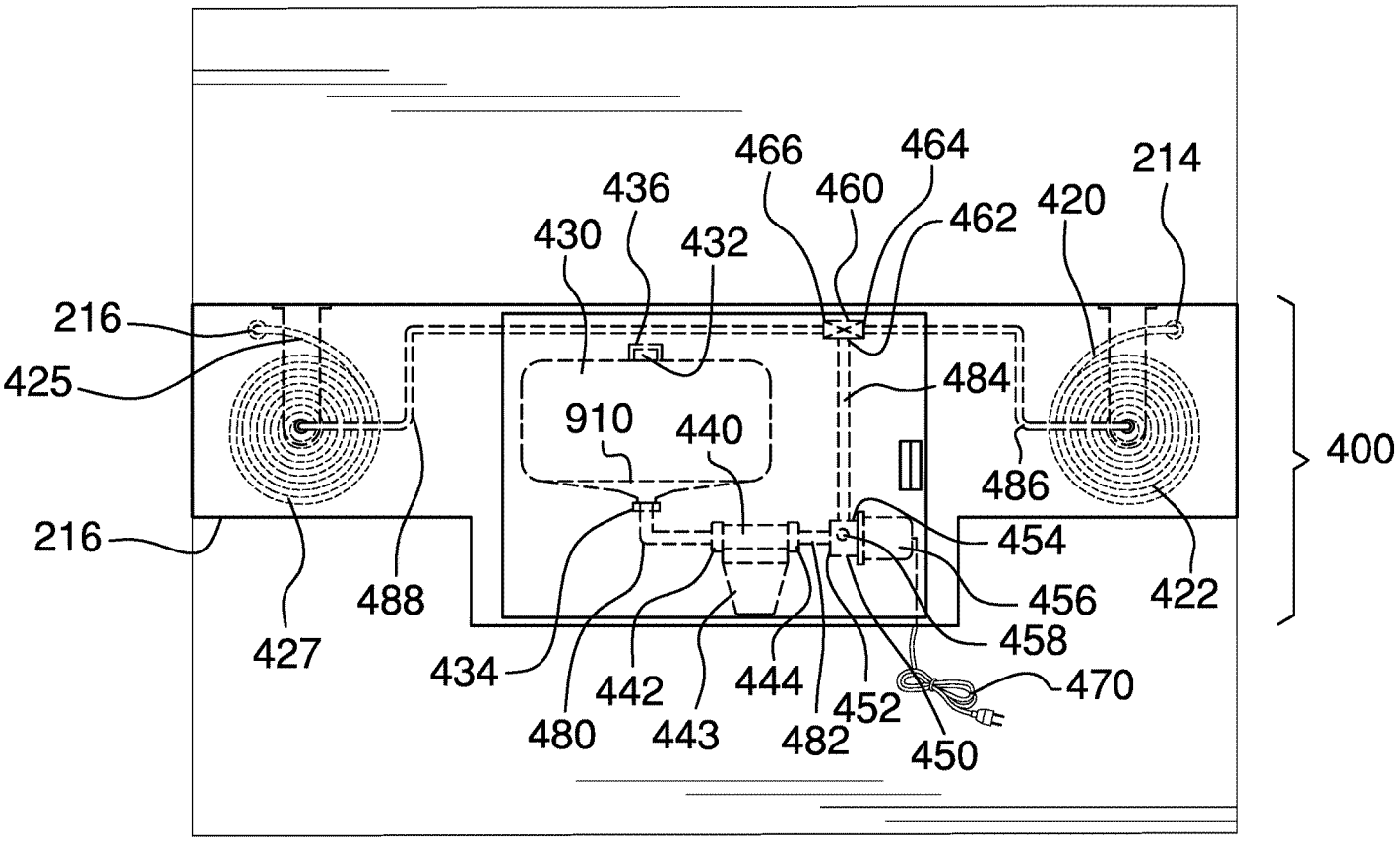
FIG. 2A is a rear view of an embodiment of the disclosure.

Referring to FIG. 2A, the water reservoir 430 may be a container for holding the water 910. The water reservoir 430 may have a refill port 432 located on the top of the water reservoir 430 and may have a reservoir outlet 434 located on the bottom of the water reservoir 430. The refill port 432 may be covered by a filler cap 436 that may be removed to refill the water reservoir 430. The water 910 flowing out of the reservoir outlet 434 may be routed to the filter 440 by a first tube 480.

The filter 440 may house porous material that removes impurities from the water 910 as the water 910 flow through the filter 440. The filter 440 may comprise a filter inlet 442 and a filter outlet 444. The water 910 may enter the filter 440 through the filter inlet 442 and may exit the filter 440 through the filter outlet 444. As the water 910 passes through the filter 440 impurities in the water 910 may become trapped within the filter 440 such that the water 910 exiting through the filter outlet 444 is cleaner than the water 910 that entered the filter 440. In some embodiments, the porous material may comprise a filter cartridge 446 that may be replaceable. The water 910 flowing out of the filter 440 may be routed to the pump 450 via a second tube 482

The pump 450 may comprise a pump inlet 452 and a pump outlet 454. The pump 450 may force the water 910 from the pump inlet 452 to the pump outlet 454 when the pump 450 is activated. As non-limiting examples, the pump 450 may be a reciprocating pump or a centrifugal pump. The pump 450 may be mechanically linked to an electric motor 456. The pump 450 may be activated when the electric motor 456 is energized. The electric motor 456 may convert electrical energy into mechanical energy. The electric motor 456 may be energized by electricity provided via an electrical cord 470. In some embodiments, a pressure sensitive switch 458 located in the pump 450 may control the energization of the electric motor 456 such that the electric motor 456 is only energized when the pressure sensitive switch 458 senses demand for the water 910 at the pump outlet 454. The water 910 flowing out of the pump 450 may be routed to the valve 460 via a third tube 484.

The valve 460 may comprise a valve inlet 462, a first valve outlet 464, and a second valve outlet 466. The valve 460 may permit and block the flow of the water 910 from the valve inlet 462 to the first valve outlet 464 or from the valve inlet 462 to the second valve outlet 466. The valve 460 may permit the flow of the water 910 from the valve inlet 462 to the first valve outlet 464 when the valve 460 senses suction applied to the first valve outlet 464. The valve 460 may permit the flow of the water 910 from the valve inlet 462 to the second valve outlet 466 when the valve 460 senses suction applied to the second valve outlet 466. The water 910 flowing out of the first valve outlet 464 may be routed to the first retractable hose 420 via a fourth tube 486. The water 910 flowing out of the second valve outlet 466 may be routed to the second retractable hose 425 via a fifth tube 488.

Those skilled in the art will recognize that the order of certain components may be changed without departing from the spirit and scope of the invention 100. As a non-limiting example, the positions of the filter 440 and the pump 450 may be reversed in some embodiments.

Figure 2B:
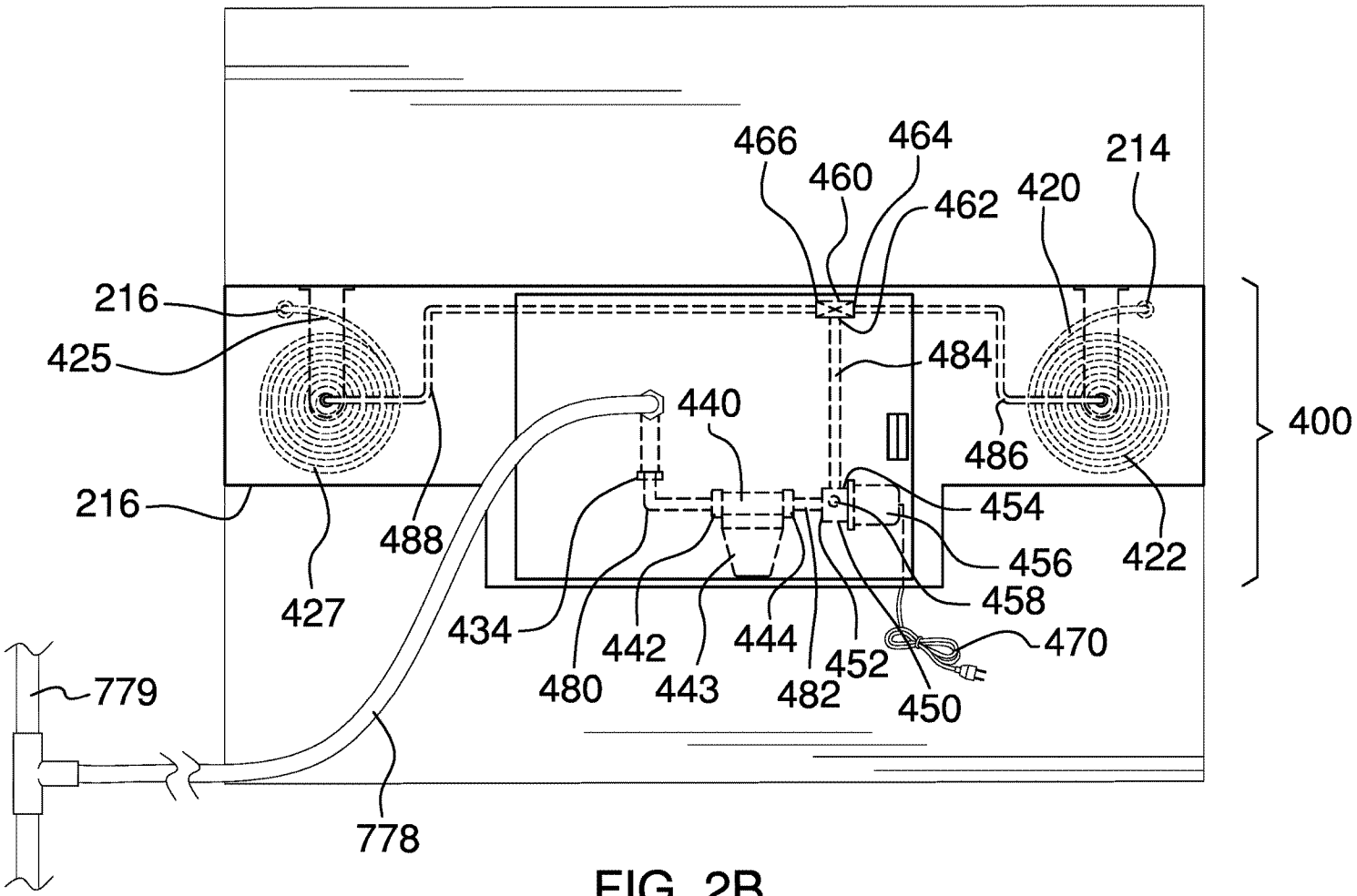
FIG. 2B is a rear view of an embodiment of the disclosure.
Figure 3:
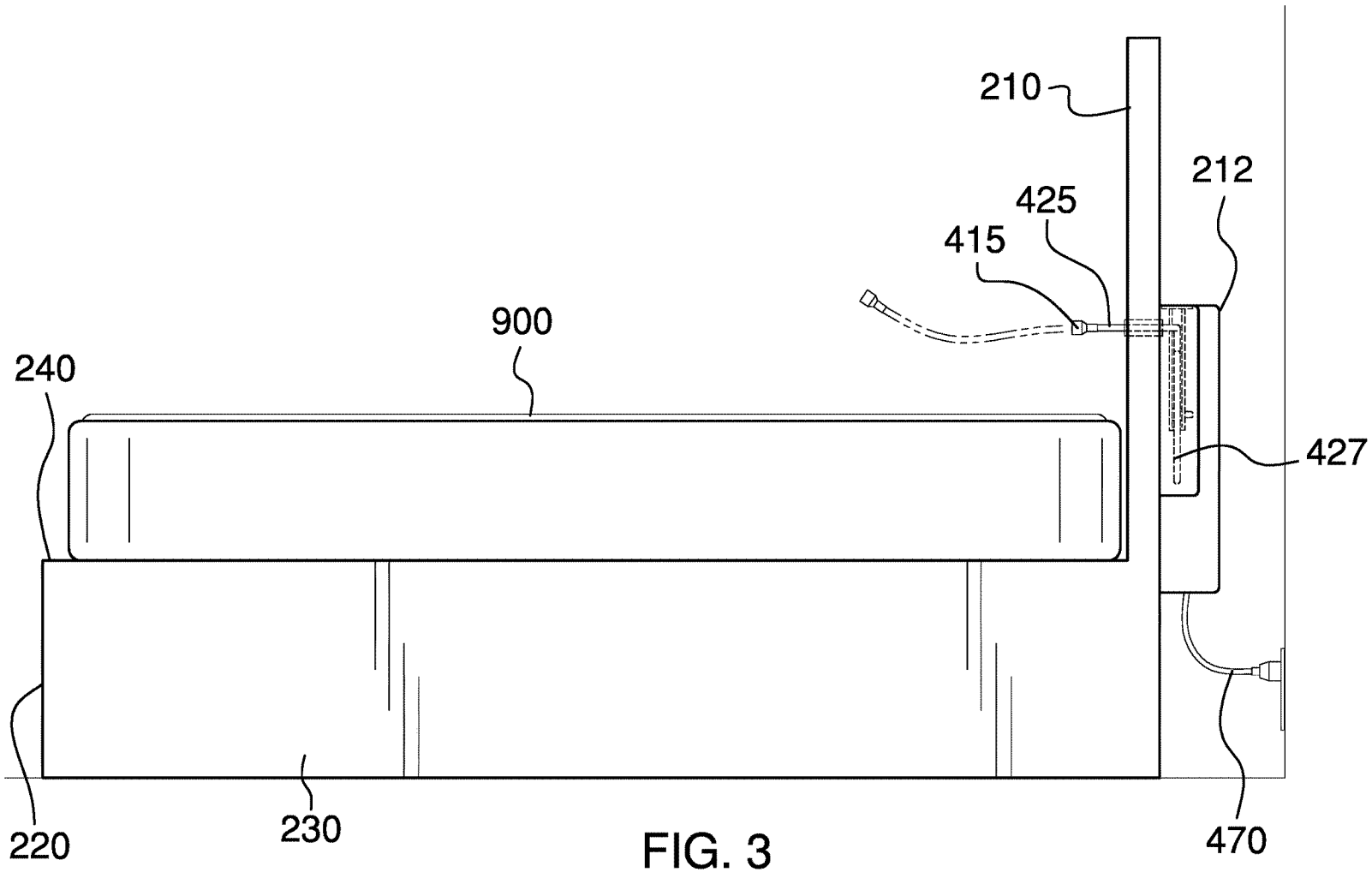
FIG. 3 is a side view of an embodiment of the disclosure.
Figure 4:
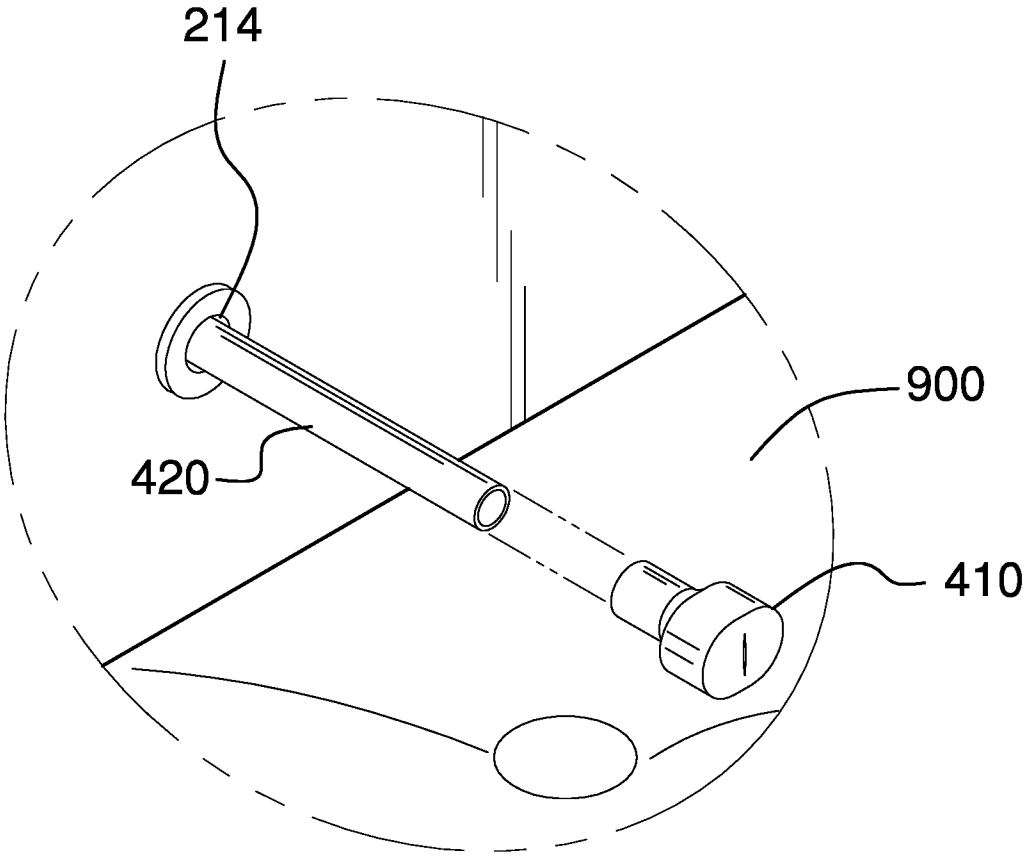
FIG. 4 is a detail view of an embodiment of the disclosure illustrating the area marked 4 in FIG. 1.
Figure 5:
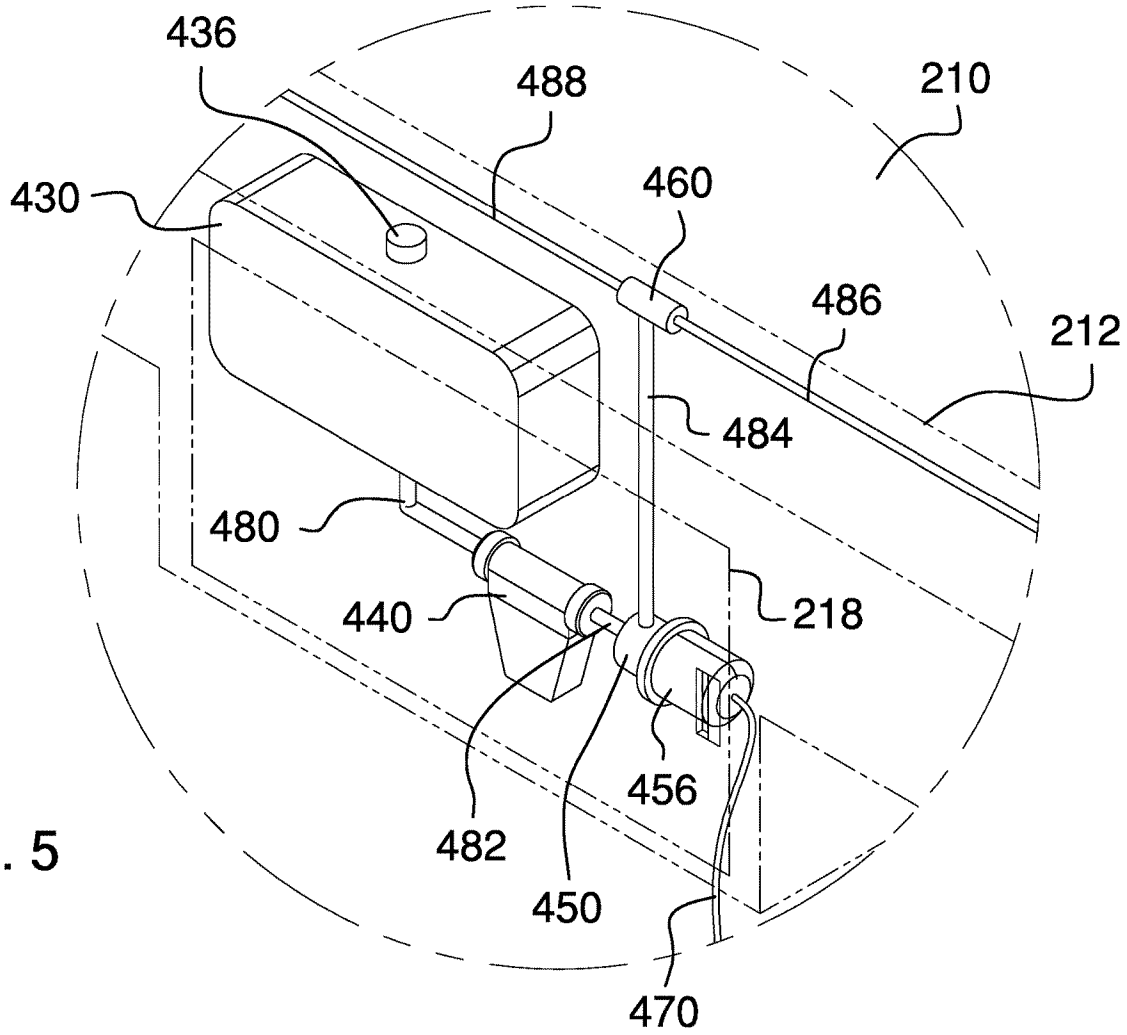
FIG. 5 is a detail view of an embodiment of the disclosure illustrating the water dispensing system from the rear.
Figure 6:
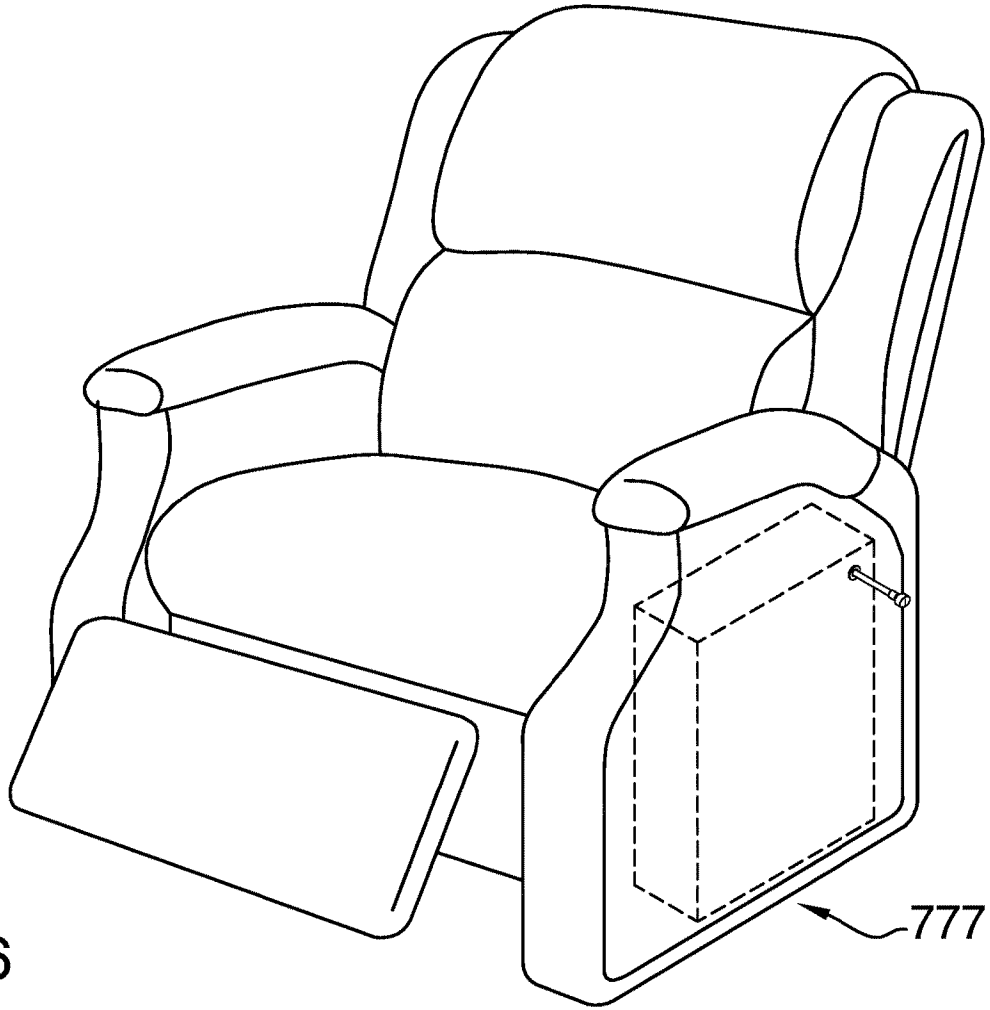
FIG. 6 is a perspective view of an alternative embodiment of the disclosure.

Referring to FIG. 2B, the water reservoir 430 may be substituted for a water line 778 that is connected to the plumbing 779 where the invention 100 is located. In this embodiment, the water reservoir 430 and the pump 450 and the electric motor 456 would also not be needed. In both scenarios, the water reservoir 430 and the water line 778 may be referred to as a water source.

The first retractable hose 420 may be tubing that may be pulled out of the front left side of the headboard 210 and which will retract into the headboard 210 when released. The first retractable hose 420 may wind around a first reel 422 when retracted into the headboard 210. The first reel 422 may be spring-load and pressure applied to the first retractable hose 420 at the front of the headboard 210 may cause the first reel 422 to rotate such that the first retractable hose 420 may be pulled off of the first reel 422 and out of the front of the headboard 210. When the pressure is released, the first reel 422 may rotate in the opposite direction and may pull the first retractable hose 420 back into the headboard 210 and around the first reel 422.

The second retractable hose 425 may be tubing that may be pulled out of the front right side of the headboard 210 and which will retract into the headboard 210 when released. The second retractable hose 425 may wind around a second reel 427 when retracted into the headboard 210. The second reel 427 may be spring-load and pressure applied to the second retractable hose 425 at the front of the headboard 210 may cause the second be pulled off of the second reel 427 and out of the front of the headboard 210. When the pressure is released, the second reel 427 may rotate in the opposite direction and may pull the second retractable hose 425 back into the headboard 210 and around the second reel 427.

The first mouthpiece 410 may be adapted to deliver the water 910 from the first retractable hose 420 into the mouth of one of the occupants of the bed. The first mouthpiece 410 may couple to the end of the first retractable hose 420 on the front left side of the headboard 210. The first mouthpiece 410 may be removable and replaceable.

The second mouthpiece 415 may be adapted to deliver the water 910 from the second retractable hose 425 into the mouth of one of the occupants of the bed. The second mouthpiece 415 may couple to the end of the second retractable hose 425 on the front right side of the headboard 210. The second mouthpiece 415 may be removable and replaceable.

The bed frame 200 comprises the headboard 210, a footboard 220, a pair of side rails 230, and a mattress platform 240. The bed frame 200 may support a mattress 900 and may house the water dispensing system 400.

The headboard 210 may be the portion of the bed frame 200 that is placed against a wall. The headboard 210 may house the water dispensing system 400 within a water system housing 212 accessible at the rear of the headboard 210. The water system housing 212 may comprise an access door 218 to provide access for servicing the water dispensing system 400. The first retractable hose 420 may be accessible through a first hose aperture 214 at the front left side of the headboard 210. The second retractable hose 425 may be accessible through a second hose aperture 216 at the front right side of the headboard 210.

The footboard 220 may be the portion of the bed frame 200 that is opposite the headboard 210.

The pair of side rails 230 may extend from the headboard 210 to the footboard 220 on both sides of the bed frame 200. The pair of side rails 230 may serve as a mounting point for the mattress platform 240.

The mattress platform 240 may couple to the pair of side rails 230 and may support the mattress 900. As a non-limiting example, the mattress platform 240 may be a plurality of wood or metal slats running laterally between the pair of side rails 230.

In use, the water 910 is placed into the water reservoir 430 by removing the filler cap 436 and pouring the water 910 into the water reservoir 430. When the occupant on the left side of the bed wants a drink of the water 910, they may grasp the first retractable hose 420 and pull it from the headboard 210. They may place the first mouthpiece 410 into their mouth and suck on the first mouthpiece 410. The valve 460 may sense the suction at the first valve outlet 464 and may release the water 910 to flow from the valve inlet 462 to the first valve outlet 464. The pressure sensitive switch 458 may sense a drop in pressure at the pump outlet 454 and may energize the electric motor 456. Energizing the electric motor 456 may activate the pump 450. Activating the pump 450 may force the water 910 from the water reservoir 430 through the filter 440 and on to the valve 460. When the first retractable hose 420 is released, it is retracted back into the headboard 210 and wraps around the first reel 422.

When the occupant on the right side of the bed wants a drink of the water 910, they may grasp the second retractable hose 425 and pull it from the headboard 210. They may place the second mouthpiece 415 into their mouth and suck on the second mouthpiece 415. The valve 460 may sense the suction at the second valve outlet 466 and may release the water 910 to flow from the valve inlet 462 to the second valve outlet 466. The pressure sensitive switch 458 may sense a drop in pressure at the pump outlet 454 and may energize the electric motor 456. Energizing the electric motor 456 may activate the pump 450. Activating the pump 450 may force the water 910 from the water reservoir 430 through the filter 440 and on to the valve 460. When the second retractable hose 425 is released, it is retracted back into the headboard 210 and wraps around the second reel 427.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, an "electric motor" is a device that converts electric energy into rotational mechanical energy.

As used herein, "energize" refers to the application of an electrical potential to a system or subsystem.

As used herein, the word "energization" refers to the act of energizing an electrical component or electrical subsystem.

As used herein, "front" indicates the side of an object that is closest to a forward direction of travel under normal use of the object or the side or part of an object that normally presents itself to view or that is normally used first. "Rear" or "back' refers to the side that is opposite the front.

As used herein, the word "hose" is intended to include hoses, tubing, piping, and other conduits capable of directing a flow of a gas or a liquid. When referring to a hose in this disclosure, the terms inner diameter and outer diameter are used as they would be used by those skilled in the plumbing arts.

As used in this disclosure, a "housing" is a rigid casing that encloses and protects one or more devices.

As used in this disclosure, the word "lateral" refers to the sides of an object or movement towards a side. Lateral directions are generally perpendicular to longitudinal directions. "Laterally" refers to movement in a lateral direction.

As used herein, "mattress" refers to a pad for supporting a reclining body. Mattresses are frequently used on beds. The mattress may be a fabric casing, sometimes quilted, and filled with hair, straw, cotton, foam rubber, a framework or metal springs, or other padding or suspension. An "air mattress" may be composed of vinyl, plastic, or another flexible airtight material and filled with pressurized air.

As used in this disclosure, a "pump" is a mechanical or electromechanical device that uses suction or pressure to raise or move fluids, compress fluids, or force a fluid into an inflatable object. As non-limiting examples, fluids may include both liquids, such as water, and gases, such as air.

As used herein, a "reel" refers to a cylindrical object with side walls around which a wire, filament, thread, cord, cable, string, line, rope, hose, tubing, or other rope-like object is wound.

As used in this disclosure, a "reservoir" refers to a container or containment system that is configured to store a liquid.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "switch" is an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, a "tube" is a hollow cylindrical device that is used for transporting liquids and/or gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other. As used here, "tubing" refers to a tube that is flexible or resilient.

As used in this disclosure, a "valve" is a device that is used to control the flow of a fluid, either gas or liquid, through a pipe or to control the flow of a fluid into and out of a container. Some valves may have multiple ports and may allow the diverting or mixing of fluids.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A water dispensing system for furniture comprising:
- a water dispensing system and an item of furniture;
- wherein the water dispensing system is adapted to dispense water to occupants of said item of furniture;
- wherein the water dispensing system includes a water source in the form of a water line or a water reservoir;
- wherein the item of furniture comprises a bed, a futon, a Murphy bed, a pull out sofa-bed, a sofa, a couch, a recliner, a settee, and a chair;
- wherein the water dispensing system comprises the water reservoir, a filter, a pump, a valve, a first retractable hose, a second retractable hose, a first mouthpiece, and a second mouthpiece;
- wherein the water stored in the water reservoir flows through the filter to remove impurities and is pumped to the valve;
- wherein the valve starts and stops the flow of the water to the first mouthpiece via the first retractable hose or to the second mouthpiece via the second retractable hose.

2. The water dispensing system for furniture according to claim 1
- wherein the water reservoir is a container for holding the water;
- wherein the water reservoir has a refill port located on the top of the water reservoir and has a reservoir outlet located on the bottom of the water reservoir;
- wherein the refill port is covered by a filler cap that is removed to refill the water reservoir;
- wherein the water flowing out of the reservoir outlet is routed to the filter by a first tube.

3. The water dispensing system for furniture according to claim 2
- wherein the filter houses porous material that removes impurities from the water as the water flow through the filter;
- wherein the filter comprises a filter inlet and a filter outlet;
- wherein the water enters the filter through the filter inlet and exits the filter through the filter outlet;
- wherein as the water passes through the filter impurities in the water become trapped within the filter such that the water exiting through the filter outlet is cleaner than the water that entered the filter;
- wherein the water flowing out of the filter is routed to the pump via a second tube.

4. The water dispensing system for furniture according to claim 3
- wherein the porous material comprises a filter cartridge that is replaceable.

5. The water dispensing system for furniture according to claim 3
- wherein the pump comprises a pump inlet and a pump outlet;
- wherein the pump forces the water from the pump inlet to the pump outlet when the pump is activated.

6. The water dispensing system for furniture according to claim 5 wherein the pump is a reciprocating pump or a centrifugal pump.

7. The water dispensing system for furniture according to claim 5
- wherein the pump is mechanically linked to an electric motor;
- wherein the pump is activated when the electric motor is energized;
- wherein the electric motor converts electrical energy into mechanical energy;
- wherein the electric motor is energized by electricity provided via an electrical cord.

8. The water dispensing system for furniture according to claim 7
- wherein a pressure sensitive switch located in the pump controls the energization of the electric motor such that the electric motor is only energized when the pressure sensitive switch senses demand for the water at the pump outlet;
- wherein the water flowing out of the pump is routed to the valve via a third tube.

9. The water dispensing system for furniture according to claim 8
- wherein the valve comprises a valve inlet, a first valve outlet, and a second valve outlet;
- wherein the valve permits and block the flow of the water from the valve inlet to the first valve outlet or from the valve inlet to the second valve outlet;
- wherein the valve permits the flow of the water from the valve inlet to the first valve outlet when the valve senses suction applied to the first valve outlet;
- wherein the valve permits the flow of the water from the valve inlet to the second valve outlet when the valve senses suction applied to the second valve outlet;
- wherein the water flowing out of the first valve outlet is routed to the first retractable hose via a fourth tube;
- wherein the water flowing out of the second valve outlet is routed to the second retractable hose via a fifth tube.

10. The water dispensing system for furniture according to claim 9
- wherein the first retractable hose is tubing that is pulled out of the front left side of the headboard and which will retract into the headboard when released;
- wherein the first retractable hose winds around a first reel when retracted into the headboard;
- wherein the first reel is spring-load and pressure applied to the first retractable hose at the front of the headboard causes the first reel to rotate such that the first retractable hose is pulled off of the first reel and out of the front of the headboard;

wherein when the pressure is released, the first reel rotates in the opposite direction and pulls the first retractable hose back into the headboard and around the first reel.

11. The water dispensing system for furniture according to claim 10 wherein the second retractable hose is tubing that is pulled out of the front right side of the headboard and which will retract into the headboard when released;

wherein the second retractable hose winds around a second reel when retracted into the headboard;

wherein the second reel is spring-load and pressure applied to the second retractable hose at the front of the headboard causes the second reel to rotate such that the second retractable hose is pulled off of the second reel and out of the front of the headboard;

wherein when the pressure is released, the second reel rotates in the opposite direction and pulls the second retractable hose back into the headboard and around the second reel.

12. The water dispensing system for furniture according to claim 11 wherein the item of furniture is a bed;

wherein the first mouthpiece is adapted to deliver the water from the first retractable hose into the mouth of one of the occupants of the bed;

wherein the first mouthpiece couples to the end of the first retractable hose on the front left side of the headboard;

wherein the first mouthpiece is removable and replaceable.

13. The water dispensing system for furniture according to claim 12 wherein the second mouthpiece is adapted to deliver the water from the second retractable hose into the mouth of one of the occupants of the bed;

wherein the second mouthpiece couples to the end of the second retractable hose on the front right side of the headboard;

wherein the second mouthpiece is removable and replaceable.

14. The water dispensing system for furniture according to claim 13 wherein a bed frame comprises the headboard, a footboard, a pair of side rails, and a mattress platform;

wherein the bed frame supports a mattress and houses the water dispensing system.

15. The water dispensing system for furniture according to claim 14 wherein the headboard is the portion of the bed frame that is placed against a wall;

wherein the headboard houses the water dispensing system within a water system housing accessible at the rear of the headboard;

wherein the water system housing comprises an access door to provide access for servicing the water dispensing system;

wherein the first retractable hose is accessible through a first hose aperture at the front left side of the headboard;

wherein the second retractable hose is accessible through a second hose aperture at the front right side of the headboard.

16. The water dispensing system for furniture according to claim 15 wherein the footboard is the portion of the bed frame that is opposite the headboard;

wherein the pair of side rails extend from the headboard to the footboard on both sides of the bed frame;

wherein the pair of side rails serve as a mounting point for the mattress platform.

17. The water dispensing system for furniture according to claim 16 wherein the mattress platform couples to the pair of side rails and supports the mattress.

18. The water dispensing system for furniture according to claim 17 wherein the mattress platform is a plurality of wood or metal slats running laterally between the pair of side rails.

* * * * *